United States Patent [19]

Descolas

[11] 4,298,367

[45] Nov. 3, 1981

[54] METHOD OF AND DEVICE FOR CLEANSING IN A FIBRE BLANKET MANUFACTURING PLANT

[75] Inventor: Jean Descolas, Le Pecq, France

[73] Assignee: Aktiebolaget Svenska Flaktfabriken, Sweden

[21] Appl. No.: 165,031

[22] Filed: Jul. 1, 1980

[30] Foreign Application Priority Data

Jul. 2, 1979 [FR] France ..... 79 17133

[51] Int. Cl.[3] ..... C03B 37/07

[52] U.S. Cl. ..... 65/4.1; 55/93; 55/226; 55/240; 261/DIG. 54; 261/112; 261/118; 65/9

[58] Field of Search ..... 55/226, 93–94; 261/DIG. 54, DIG. 56, 116–118, 112; 65/4.1, 2, 9, 5; 156/62.2, 62.4, 62.6, 62.8; 98/115 SB

[56] References Cited

U.S. PATENT DOCUMENTS 2,337,983 12/1943 Fisher ..... 55/241
3,795,093 3/1974 Gerhard et al. ..... 55/240
3,881,898 5/1975 Darby et al. ..... 55/226
4,105,424 8/1978 Levecque et al. ..... 65/5
4,239,512 12/1980 Dobias ..... 261/118

*Primary Examiner*—Bernard Nozick
*Attorney, Agent, or Firm*—Steinberg & Raskin

[57] ABSTRACT

In a plant of making a blanket from fibres which are thrown or set together with polymerizable binder particles or droplets onto a perforated conveying belt, a method of cleansing consisting in: associating means for sucking air loaded with fibre dust and binder particles or droplets with means for spraying a washing liquid to be processed afterwards, providing, below said conveying belt, series of Venturi nozzles with throats of adjustable cross-section, opening into a duct connected to suction means, and distributor manifolds for spraying said washing liquid at low pressure, positioned on the one hand at the inlets of said Venturi nozzles and on the other hand downstream of the outlets thereof to provide a streaming of liquid onto all the walls of the dust removing ducts or means on which dusts and binder are likely to settle down.

11 Claims, 2 Drawing Figures

METHOD OF AND DEVICE FOR CLEANSING IN A FIBRE BLANKET MANUFACTURING PLANT

Figure 2:
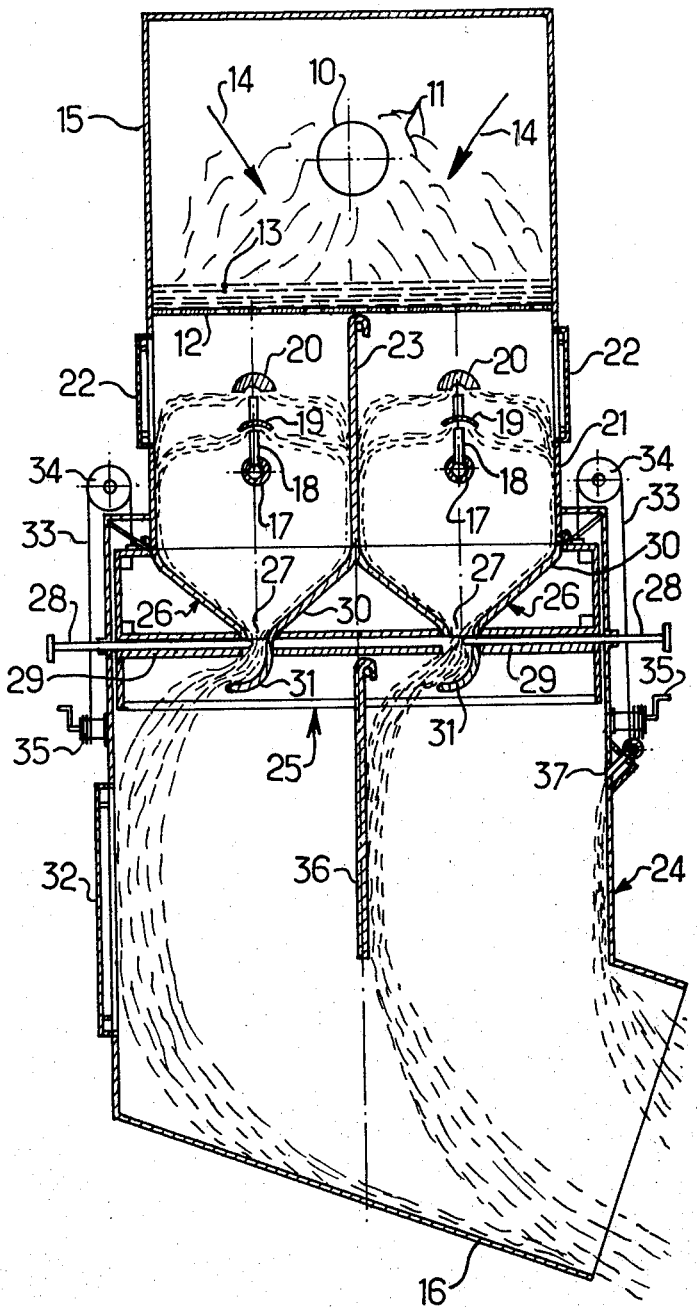

The invention relates generally to a method and a device for cleansing or cleaning and purifying gases loaded with fibres, dust and gaseous effluents containing polymerizable materials in a plant for manufacturing a blanket made from fibres, for instance mineral fibres such as glass wool or rock wool or from vegetable fibres such as linen fibres, wood fibres or from any other substance.

The mineral or vegetable fibre blankets are generally made by throwing fibres by means of a rotary die or nozzle onto a conveying belt contained within an elongated enclosure. An air suction below the conveying belt would cause the fibres to lay themselves down onto that belt so as to form a blanket. A polymerizable binder is also thrown at the same time as the fibres onto the belt so as to bond the fibres into a blanket.

In the present state of the art, the suction or drawing in of air underneath the conveying belt which is generally of the perforated or foraminous kind, is performed by means of suction fans or blowers. In order to prevent the polymerizable binder particles to settle down onto the walls of the enclosure or on ducts located below the conveying belt and connected to the fans, distributing manifolds for spraying a washing liquid at high pressure, generally water, are provided below the conveying belt. It is found however in practice that such expedients are inadequate and that the polymerizable binder would settle on the vanes of the fan or fans and solidify thereon. This deposit would result in a static and dynamic want of balance of the vanes of the fans which after a very short time become unable to operate. It is then necessary to disassemble the fans and to clean them with a cold-chisel. The use of a washing liquid at high pressure in the spray distributing manifolds would also result in a very quick wear of the spraying nozzles, a hazard of fouling and clogging of such nozzles, etc. A defective spraying of washing liquid would result forthwith in a deposition of polymerizable binder and dusts onto the walls of the pipe-lines leading to the fans.

Indeed the object of the present invention is to avoid these inconveniences of the prior art and for this purpose it provides a method of cleansing in a plant for manufacturing a blanket made from fibres such as glass wool or rock wool which are thrown or set down together with polymerizable binder particles or droplets onto a perforated or foraminous conveying belt, the invention being characterized in that it consists in providing below said conveying belt a series of suction means for drawing in the air loaded with fibre dusts and with binder particles or droplets, controlling or adjusting the suction of these means according to their positions or locations underneath the conveying belt so as to obtain on said belt the formation or building up of a fibre blanket with a constant thickness and/or specific gravity, associating with these suction means, means for spraying a washing liquid at low pressure such as water so as to catch or pick up and collect or gather the binder dusts and particles or droplets being in suspension in the air and then to treat or process this washing liquid.

According to another characterizing feature of the invention, this method consists in positioning, underneath the conveying belt, series of Venturi nozzles having throats with adjustable cross-sectional surface areas, opening into a duct connected to suction means and distributing manifolds for spraying washing liquid at low pressure such as water, located on the one hand at the inlets of the Venturi nozzles and on the other hand downstream of the outlets thereof to generate a liquid streaming on all the walls of the ducts or dust-removing means on which dusts and the binder are likely to settle down.

The invention also proposes a cleansing device in a plant for making a fibre blanket, for carrying out the method according to the invention and characterized in that it comprises, below the conveying belt for building up the fibre blanket, an enclosure or casing the top or upper portion of which is closed by the conveying belt and which contains a series of lengthwise aligned box-like cases forming Venturi nozzles with throats having adjustable cross-sectional surface areas, positioned below the conveying belt, distributing manifolds for spraying a washing liquid at low pressure such as water in order to generate a liquid streaming on the walls of the enclosure and box-like cases, the outlet of said enclosure being connected to air suction means, and means for adjusting the cross-sectional surface areas of the throats of the Venturi nozzles.

Figure 1:
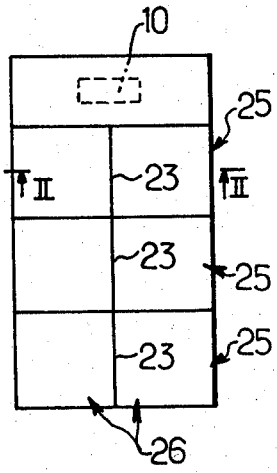

The invention will be better understood and further objects, characterizing features, details and advantages thereof will appear more clearly as the explanatory description proceeds with reference to the accompanying diagrammatic drawings given by way of non limiting example only illustrating a presently preferred specific embodiment of the invention and wherein:

FIG. 1 is a diagrammatic top or plan view showing the lay-out of a cleansing device according to the invention provided underneath the conveying belt for building up a fibre blanket; and FIG. 2 is a view in cross-section on a larger scale taken upon the line II—II of FIG. 1.

A plant for manufacturing a blanket from fibres such as glass wool or rock wool generally comprises as shown very diagrammatically a generating head 10 such as a rotary or revolving die which throws fibres 11 onto a conveyor belt 12 of the perforated or foraminous type on which the fibre blanket 13 is building up. A polymerizable binder is also thrown as shown by the arrows 14 onto the conveyor belt 12 together with the fibres 11 so as to form the blanket 13. The enclosure or casing containing the rotary die 10 and the binder spray means has been shown very diagrammatically at 15 and comprises air intakes.

The air from the inside of the enclosure 15 is sucked or drawn in through the conveying belt 12 by suction fans or blowers not shown, mounted at the end of the duct 16.

This suction which is performed on a length of conveying belt 12 would cause the fibres and the binder to be brought or drawn onto the belt 12 to form the blanket 13.

It will be understood that the air flowing through the conveying belt 12 and sucked through the duct 16 towards the suction means will be loaded with fibre dusts and polymerizable binder which would tend to settle down and to stick or adhere forthwith onto all the walls they may meet between the conveying belt 12 and the suction means. The mixture of dust and binder stuck or adhering on these walls is then very difficult to be removed therefrom.

To solve this problem the invention therefore provides a series of means which will be described in detail hereinafter.

The invention at first provides distributing manifolds 17 for spraying a washing liquid at low pressure such as water below the conveying belt 12. The distributing manifolds 17 extend lengthwise and horizontally underneath this belt and they are provided with spraying nozzles 18 above the tops of which are positioned cups or bell-caps 19 and 20 provided at two different heights. The nozzles 18 have relatively large diameters so that they may not be clogged or obstructed. Neither are they exposed to a very quick erosion as the liquid flowing within the pipe-lines 17 is at a low pressure.

The liquid issuing from nozzles 18 hits or impinges on the cups 19 and 20 and is sprayed onto the walls of an enclosure 21 located below the conveying belt 12. This enclosure 21 is provided with inspection doors 22 to allow the inspection and maintenance of the water spraying arrangements 17, 18, 19 and 20. A central partition wall 23 is removably hung up on a rod extending just below the conveying belt 12.

Underneath said enclosure 21 there is another enclosure or casing 24, the top part of which is connected to the enclosure 21 and the lower part or bottom of which is connected to a duct 16 leading to said suction fans.

Inside of this enclosure 24 are provided box-like cases 25 only one of which is shown in cross-section on FIG. 2 and which are three in number on FIG. 1, being longitudinally aligned end to end.

Each box-like case 25 comprises two Venturi nozzles 26 which are transversally juxtaposed within the box-like case. Each V-like Venturi nozzle 26 is of a lengthwise elongated shape, its throat 27 consisting of an elongated rectangular slot. The cross-sectional passage-way surface area of the throat 27 is adjustable by means of a plate 28 which is slidably mounted between two guiding plates 29 of the box-like case and the inner end of which is more or less shutting the slot forming the throat 27 of the Venturi nozzle.

It should be noted that one of the walls 30 forming one of the longitudinal sides of the Venturi nozzle terminates below the throat 27 into a curved spoon-shaped portion 31.

Each box-like case 25 is mounted to be vertically movable within the enclosure 24 between an upper working position which is the one shown in FIG. 2 and a lower position not shown in which the box-like case 25 is brought to be in front of an inspection door 32 of the enclosure 24. In that bottom position the box-like case 25 may be withdrawn from the enclosure 24 with a view to being cleaned or replaced.

Each box-like case 25 may be supported by a rigid frame connected to handling cables or ropes 33 reeved over sheaves 34 and leading to winches 35 or each box-like case 25 may itself be connected directly to the ropes or cables 33.

A central partition 36 similar to said removable central partition 23 is hung up under each box-like case 36.

The device which has just been described operates in the following manner:

The washing liquid at low pressure flowing within the pipe-lines 17 is sprayed by means of the cups 19 and 20 onto the inside walls of the enclosure 21 and onto both opposite faces of the central partition 23. This liquid would stream on these walls and enter the box-like cases 25 (located in their operating upper position) while streaming onto the walls 30 forming the Venturi nozzles 26. At the throat 27 occurs a rather strong atomization of the fluid flowing through the Venturi nozzles 26 and comprising the streaming water and the air loaded with dust and binder. Owing to such an atomization an intimate mixture of washing water, air, dust and binder is achieved, the dusts being driven through impact into the water droplets.

The spoon-shaped portion 31 placed at the outlet of the throat 27 of each Venturi nozzle 26 causes the mist of water resulting from the atomization to be converted again through impact into large droplets. The mixture of liquid and air issuing from the Venturi nozzles 26 is guided by the portions 31 on the one hand along some of the inner walls of the enclosure 24, and on the other hand along a face of the central partition 36. Distributing manifolds for spraying washing liquid at low pressure shown at 37 are provided on the other walls of the enclosure 24 so as to avoid on the latter any deposition or settling and any sticking or adhering of the dust and binder thereon.

The liquid and the air would then flow through the duct 16.

It may be appreciated that a very good cleansing of the air sucked through the conveying belt 12 is thus obtained and that the air which reaches the vanes of the fans does no longer contain any binder and dust.

The washing liquid loaded with dust and binder is processed in a conventional manner for separating the dusts and the binders, and then is advantageously recycled into the spraying manifolds 17 and 37.

It should be noted that advantageously some at least of the walls of the means which have just been described and which are likely to receive a deposition or settling of dust and binder may be covered or lined with an adhesive sheet or foil of plastics material whereby it is very easy to clean such walls. After some time of use or operation it suffices to remove these adhesive sheets and to substitute others therefor.

It should further be noted that the method and the device according to the invention which have just been described still allow to obtain another extremely interesting technical advantage.

Indeed since a number of box-like cases 25 (three in number in the example shown on FIG. 1) are longitudinally aligned below the conveying belt 12 to extend substantially from the revolving die 10, it is possible by correctly adjusting the cross-sectional passage-way surface areas of the throats 27 of the Venturi nozzles 26 to obtain on a length of the conveying belt 12, a pattern of pressure or head losses such that the fibre blanket 13 built up on the belt 12 would have a constant thickness and/or specific gravity. In the prior art which does not allow such an adjustment the fibres would tend to settle or lay down onto the belt 13 at that position where the suction is strongest i.e. at the place closest or next to a suction fan. With the method and the device according to the invention, it is possible on the contrary to obtain an even or regular and uniform deposition of fibres over the whole useful length of the backing belt 12.

The number of box-like cases 25 which may be provided lengthwise the one after the other, is of course variable to a large extent. Also, each box-like case 25 may include several transversally juxtaposed Venturi nozzles, their number being not compulsorily two as in the example illustrated in FIG. 2.

It should therefore be understood that the invention is not at all limited to the embodiment described and shown which has been given by way of example only and that it comprises all the technical equivalents as well as their combinations if same are carried out and used within the scope of the appended claims.

What is claimed is:

1. A method of cleansing, in a plant for manufacturing a blanket from fibres such as glass fibres or rock fibres which are thrown or set together with polymerizable binder particles or droplets onto a perforated conveying belt, consisting in associating means for sucking air loaded with fibre dust and binder particles or droplets with means for spraying a washing liquid such as water and then processing this washing liquid, wherein the improvement consists in positioning below said conveying belt series of Venturi nozzles having throats with adjustable cross-sectional passageway surface areas, opening into a duct connected to suction means, and distributor manifolds for spraying washing liquid at low pressure such as water arranged on the one hand at the inlets of said Venturi nozzles and on the other hand downstream of the outlets of said Venturi nozzles to provide a streaming of liquid onto all the walls of the dust removing ducts or means on which dusts and binder are likely to settle down.

2. A method according to claim 1, consisting in providing, below the conveying belt, at least two adjacent rows on longitudinally aligned Venturi nozzles.

3. A method according to claim 1, consisting in protecting at least some of the walls of said ducts and suction means by means of sheets of flexible plastics material removably secured such as being adhesively bonded onto said walls.

4. A device for cleansing in a plant for making a fibre blanket, comprising a perforated conveying belt onto which are thrown or set fibres such as glass fibres or rock fibres together with polymerizable binder particles or droplets, wherein the improvement consists in the provision, below said conveying belt, of an enclosure the upper part of which is shut by said conveying belt and which contains a series of lengthwise aligned box-like cases forming Venturi nozzles with throats of adjustable cross-sectional passage-way surface areas, distributing manifolds for spraying a washing liquid at low pressure such as water so as to provide a streaming of liquid on the walls of said enclosure and box-like cases, the outlet of said enclosure being connected to air suction means and means for adjusting the cross-sectional passage-way surface areas of said throats of said Venturi nozzles.

5. A device according to claim 4, wherein said distributing manifolds for spraying washing liquid extend lengthwise above the inlets of said Venturi nozzles and are provided with sprinkling nozzles on two different levels.

6. A device according to claim 4, wherein at least one of the walls of said enclosure comprises, downstream of said Venturi nozzles, one distributing manifold for spraying a washing liquid.

7. A device according to claim 4, comprising a plurality of said box-like cases arranged in longitudinally juxtaposed relationship, each box-like case comprising at least two transversally juxtaposed Venturi nozzles.

8. A device according to claim 4, wherein said Venturi nozzles are of elongated longitudinal shape with a substantially V-like cross-section, the throat of each Venturi nozzle consisting of a slot having a substantially rectangular elongated shape of adjustable width.

9. A device according to claim 4, wherein the outlet of each Venturi nozzle comprises a longitudinal plate with a curved cross-section on which impinges the flow of fluid issuing from said Venturi nozzle.

10. A device according to claim 4, wherein said box-like cases are arranged to be vertically movable inside of said enclosure between an upper working position where they are bearing in fluid-tight relationship on a horizontal top wall on said enclosure and a lower rest position located on a level with inspection doors provided in the wall of said enclosure whereby said box-like cases are removable from said enclosure.

11. A device according to claim 10, wherein said box-like cases are supported by rigid frames connected to lifting means such as cable-type lifting means adapted to displace said box-like cases between both of their aforesaid positions.

* * * * *